United States Patent [19]

Sakamoto

[11] Patent Number: 4,732,314

[45] Date of Patent: Mar. 22, 1988

[54] METHOD OF MANUFACTURING A METAL-BASED COMPOSITE MATERIAL

[75] Inventor: Akira Sakamoto, Toyoake, Japan

[73] Assignee: Director-General of Agency of Industrial Science and Technology, Tokyo, Japan

[21] Appl. No.: 885,596

[22] PCT Filed: Nov. 12, 1985

[86] PCT No: PCT/JP85/00629

§371 Date: Jul. 8, 1986

§102(e) Date: Jul. 8, 1986

[30] Foreign Application Priority Data

Nov. 12, 1984 [JP] Japan ..... 59-236769
Nov. 12, 1985 [WO] PCT Int'l Appl. ... PCT/JP85/00629

[51] Int. Cl.[4] ..... B23K 31/02

[52] U.S. Cl. ..... 228/190; 228/221; 228/242

[58] Field of Search ..... 228/211, 242, 190, 233, 228/239; 419/11, 12; 29/419

[56] References Cited

U.S. PATENT DOCUMENTS

| | | | |
|---|---|---|---|
| 2,947,077 | 8/1960 | Lazarus | 228/190 |
| 3,419,952 | 1/1969 | Carlson | 228/190 |
| 3,699,623 | 10/1972 | Kreider | 29/156.8 B |
| 3,729,805 | 5/1973 | Mollica et al. | 228/190 |
| 3,748,721 | 7/1973 | Alexander | 228/185 |
| 3,936,277 | 2/1976 | Jackway et al. | 228/190 |
| 4,010,884 | 3/1977 | Rothman | 228/190 |
| 4,260,441 | 4/1981 | Prewo | 228/190 |

FOREIGN PATENT DOCUMENTS

| | | |
|---|---|---|
| 1171609 | 7/1984 | Canada . |
| 56-98435 | 8/1981 | Japan . |
| A204139 | 5/1982 | Japan . |
| 58-204139 | 11/1983 | Japan . |

OTHER PUBLICATIONS

Van Vlack, Elements of Materials Science and Engineering, pp. 316, 332 and 313, Addison-Wesley (1975).

*Primary Examiner*—Nicholas P. Godici
*Assistant Examiner*—Karen Skillman
*Attorney, Agent, or Firm*—Oblon, Fisher, Spivak, McClelland & Maier

[57] ABSTRACT

The invention provides a method of manufacturing a metal-based composite material, in which the interfacial reaction between an inorganic fiber reinforcing material and a matrix metal such Al or Mg during press forming of the metal-based composite material is suppressed, and the resultant material has an excellent composite state.

In the method of the invention, a preform laminate or sandwiched body consisting of the inorganic fiber reinforcing material and the matrix metal is packed in a sealing metal container. After the interior of the container is evacuated, the container is rapidly heated to a temperature higher than the solidus of the matrix metal. Immediately thereafter, while a vacuum pressure is kept unchanged, the container is pressed between a pair of platens kept at a temperature lower than the solidus of the metal, thereby obtaining a composite material of the reinforcing material and the metal.

6 Claims, 4 Drawing Figures

METHOD OF MANUFACTURING A METAL-BASED COMPOSITE MATERIAL

Technical Field

The present invention relates to a method of manufacturing a reinforced metal-based composite material in which a fibrous inorganic reinforcing material such as carbon fiber, silicon carbide fiber, boron fiber, or silicon carbide whisker is dispersed as a reinforcing material in a metal matrix.

BACKGROUND ART

A hot press method is known as one of the conventional methods of manufacturing metal-based composite materials. According to these methods, a laminate of intermediates, called a preform, such as: (1) a green tape {fiber is placed on a foil layer (packing foil) of a matrix metal and is adhered and fixed with an acrylic or styrene resin}, (2) a sprayed tape {in item (1) above, the fiber is covered and fixed with a sprayed matrix metal in place of the resin}, or (3) an impregnated wire preform (a fier bundle is immersed in molten matrix metal and the fiber bundle is infiltrated with the molten metal) is heated and pressed to prepare a composite material.

This heating/pressing method includes the solid phase press method for processign in a solid phase region of the matrix metal, and the liquid phase press method for processing in a solid/liquid phase coexisting region or a liquid phase region higher than the solidus of the matrix metal. In the former method, the heating temperature is relatively low, and degradation of the fiber due to the interfacial reaction between the fiber and matrix metal during forming is small. However, in order to obtain a composite material, high pressure processes are normally required, resulting in high equipment and manufacturing costs. In the latter method, forming can be performed with low-pressure processes, and advantages in respect to the equipment and manufacturing costs are obtained. However, the heating temperature during forming is high, and degradation of the fiber by the interfacial reaction and formation of a brittle phase at the interface tend to occur. As a result, the obtained composite material tends to have poor mechanical properties.

It is, therefore, an object of the present invention to provide a method of manufacturing a composite material with excellent mechanical properties, in which the interfacial reaction caused in the conventional liquid phase press method is suppressed.

Disclosure of Invention

There is provided according to the present invention, a method of manufacturing a metal-based composite material, characterized in that a preform laminate consisting of a fibrous inorganic reinforcing material and aluminum, an aluminum alloy, magnesium or a magnesium alloy, or a sandwiched body of the reinforcing material and the metal sheets or foil layers is packed in a sealing metal container, the container is rapidly heated to a temperature higher than the solidus of the metal while it is maintained in a vacuum, and immediately thereafter the container is compressed by a platen heated to and kept at a temperature lower than the solidus of the metal, thereby preparing a composite material of the reinforcing material and the metal.

The fibrous inorganic material which can be used herein is not particularly limited. However, in general, fibrous inorganic materials having excellent heat resistance, strength, and wear resistance, such as carbon fiber, silicon carbide fiber, boron fiber, alumina fiber, graphite whisker, silicon carbide whisker, alumina whisker, or silicon nitride whisker can be used.

The base metal of the composite material is preferably aluminum, magnesium, an aluminum alloy, or a magnesium alloy. The type of aluminum alloy to be used is not particularly limited and any general aluminum alloy can be used. however, an aluminum alloy containing 80% by weight or more of A1 is particularly preferable. Examples of aluminum alloys include 2024, 3003, 5052, 7075, 7475, and the like. The type of magnesium alloy is not particularly limited, either, and any general magnesium alloy can be used. However, a magnesium alloy containing 80% by weight or more of Mg is particularly preferable. Examples of magnesium alloys include AZ31, AZ61A, ZK60A, and the like.

A preform consisting of an inorganic reinforcing material and a matrix metal used herein can be a green tape, a sprayed tape, or an infiltrated wire preform as described above, as well as a mixture of an inorganic material and a powder metal.

The sealing metal container for containing such a preform laminate or sandwiched body in a vacuum generally consists of mild steel or stainless steel. However, titanium, nickel, alloys thereof, or other suitable metals can also be used. The wall thickness of the container must be set to withstand the required vacuum pressure (normally $10^{-2}$ Torr or less, and preferably $5\times10^{-3}$ Torr or less). In general, a container having a wall thickness of 1 mm or less is used.

The characteristic feature of the method of the present invention resides in that the interfacial reaction between the inorganic reinforcing material and the matrix metal during press forming of the metal-based composite material is suppressed, and an excellent composite state of the material is obtained. In order to achieve this, measures to satisfy the following conditions are taken:

(1) the heating time for heating the raw material to a temperature higher than the solidus is kept short, and the time in which the reinforcing material and the matrix metal contact each other is kept extremely short; and (2) compression pressure must be applied at a point in time at which the raw material is heated to a temperature higher than the solidus. In order to obtain a good composite state, a given compression time and pressure must be set. The temperature at which compression is performed is kept as high as possible within a range in which the interfacial reaction is negligible.

According to the present invention, since the difference between the maximum temperature and the compression temperature is relatively small, the resultant composite material is only slightly distorted.

Best Mode of Carrying Out the Invention

The illustrated embodiment of the present invention will be described hereinafter.

Figure 1:
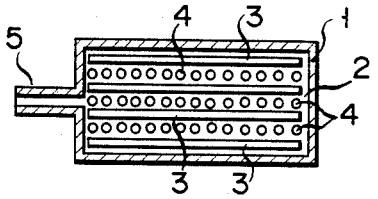
FIGS. 1 to 3 are sectional views showing the sequential steps of the method according to the present invention.
Figure 2:
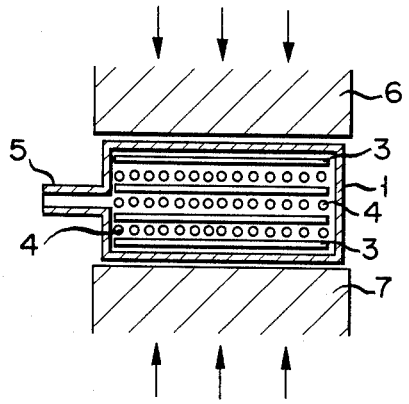
Figure 3:
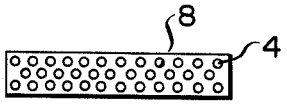

FIGS. 1 to 3 show a case wherein a composite material is prepared using a green tape obtained by sandwiching inorganic reinforcing fiber between each two adjacent metal foil layers.

As shown in FIG. 1, a preform consisting of green tape 2 is packed in thin steel sealing container 1 having a thickness of 0.8 mm. Green tape 2 comprises a laminate obtained by sandwiching reinforcing material 4 of inorganic fiber between matrix metal foil layers 3 of aluminum or the like. Green tape 2 of desired thickness and size is filled in container 1.

The interior of container 1 is evacuated through port 5 to a vacuum of, e.g., $10^{-2}$ Torr or less. While container 1 is kept at this vacuum pressure, it is rapidly heated to a temperature higher than the solidus of the matrix metal by infrared ray heating, or by using a salt bath furnace or fluid particle furnace. The heating temperature is 50° C./min. or higher, and preferably 100° C./min.: the higher the better. Immediately thereafter, as shown in FIG. 2, container 1 is pressed from above and below, and is kept pressed for a predetermined period of time by a press having a pair of platens 6 and 7 heated to a specific temperature lower than the solidus of the matrix metal. The vacuum pressure is kept unchanged during this compression.

This is for preventing oxidation of matrix metal 3 and reinforcing material 4. After cooling, metal-based composite material 8 filled with reinforcing material 4 is obtained from collapsed container 1, as shown in FIG. 3.

Figure 4:
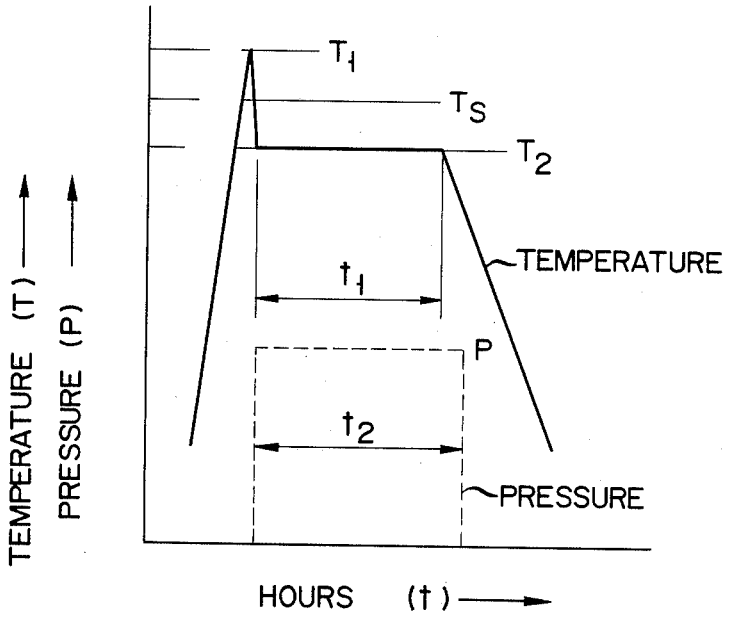
FIG. 4 is a graph showing the temperature and pressure of a press with platens in the manufacture of the composite material according to the present invention.

FIG. 4 is a graph showing the temperature and compression cycle in the manufacturing process of the composite material. Referring to FIG. 4, temperature $T_1$ is generally set to fall within a range of $T_s$ to $T_s+100°$ C. (where $T_s$ is the solidus of the matrix metal), although the range is different depending upon the material system (the combination of the fiber or the like and the matrix metal) and the type of preform or the like. However, as long as a composite material is obtained, the lower the temperature, the better. This is because the interfacial reaction is suppressed at lower temperatures. Platen heating temperature $T_2$ also changes in accordance with the material. However, in general, the platen heating temperature is as high as possible (since a lower pressure can be advantageously used at higher temperatures) within a range of $T_s$–200° C. to $T_s$, in which range degradation of mechanical performance of the composite material due to fiber degradation by the interfacial reaction, generation of a brittle phase, or the like is practically negligible in time (t) for holding compression pressure P. Compression time $t_1$ at $T_2$ is as short as possible, as long as adhesion between the fiber and the matrix metal or metals is sufficient. Compression pressure P must be changed in accordance with the material system, the type of preform, the shape and size of the composite material, and the like. However, compression pressure P must be high in the solid plate press method performed at temperatures lower than the solidus, e.g., about 4.0 kg f/mm$^2$ for boron fiber/aluminum alloy systems, and about 9.0 kg f/mm$^2$ for carbon fiber-/aluminum alloy systems. However, compression pressure P can be, in general, a maximum of 4.0 kg f/mm$^2$ in the liquid phase press method performed at temperatures higher than the solidus, according to the present invention. Total compression time $t_2$ is set to be the same as or longer than $t_1$. For example, $t_2$ is longer than $t_1$ by 15 minutes or more. Distortion of the composite material formed body is reduced when a cooling rate after keeping the material at $T_2$ for $t_1$ is small, and $t_2$ is long.

The present invention will now be described by way of its Examples.

Tables 1 and 2 below show the compositions of the matrix metals used in Examples 1,2, and 4.

TABLE 1

| Element | % by weight Al Alloy 6061 | Al Alloy 2319 |
|---|---|---|
| Mg | 0.8–1.2 | 0.02 or less |
| Si | 0.4–0.8 | 0.20 or less |
| Cu | 0.15–0.40 | 5.8–6.8 |
| Cr | 0.04–0.35 | — |
| Fe | 0.7 or less | 0.50 or less |
| Mn | 0.15 or less | 0.20–0.40 |
| Zn | 0.25 or less | 0.10 or less |
| Ti | 0.15 or less | 0.10–0.20 |
| V | — | 0.05–0.15 |
| Zr | — | 0.10–0.25 |
| Other impurities | 0.15 or less | 0.15 or less |
| Al | Balance | Balance |

Mg Alloy AZ31B Components

| Element | % by weight |
|---|---|
| Al | 2.5–3.5 |
| Zn | 0.7–1.3 |
| Mn | 0.20 or less |
| Si | 0.10 or less |
| Ca | 0.04 or less |
| Cu | 0.05 or less |
| Ni | 0.005 or less |
| Fe | 0.005 or less |
| Other impurities | 0.30 or less |
| Mg | Balance |

EXAMPLE 1

Material System

Fiber: Pitch-type carbon fiber (tensile strength: 210 kg f/mm$^2$, modulus of elasticity: $40\times10^2$ kg f/mm$^2$)

Matrix metal: A1 alloy 6061 (solidus: about 580° C., liquidus: about 650° C.)

PREFORM

Infiltrated wire preform (volume ratio of carbon fiber: 50%)

Forming Process of Composite Material

The unidirectionally oriented laminate of the preform was packed in a sealing container consisting of a thin plate of mild steel. After the interior of the container was evacuated by a vacuum pump through an evacuation port from a pressure of $5\times-10^{-2}$ to $1\times10^{-2}$ Torr, it was heated to 615° C. at a rate of 100° C./min by an infrared heater. When the container temperature reached 615° C., the container was transferred to a hot press and hot-pressed. Hot pressing was performed under conditions: $T_1=615°$ C., $T_2=500°$ C., $t_1=t_2=30$ min, and P=3.5 kg f/mm$^2$. The cooling rate from $T_2$ was set at 2° C./min.

The unidirectional reinforced composite material obtained by the forming had a tensile strength of 100 kg f/mm$^2$ or more.

EXAMPLE 2

Material System

Fiber: PAN (polyacrylonitrile) type carbon fiber (high modulus of elasticity type) (tensile strength 230 kg f/mm$^3$, modulus of elasticity: $42\times10^3$ kg f/mm$^2$)
Matrix metal: Al alloy 2319 (solidus: about 545° C., liquids: about 645° C.)

Preform

Sprayed preform (volume ratio of carbon fiber: 40%)

The unidirectionally oriented laminate of the preform was packed in a sealing container consisting of a thin plate of mild steel. After the interior of the container was evacuated by a vacuum pump through an evacuation port from a pressure of $5\times10^{-2}$ to $1\times10^{-2}$ Torr, it was heated to 670° C. at a rate of 100° C./min. by an infrared heater. After the container was kept at 670° C. for 5 min, it was transferred to a hot press and hot-pressed. Hot pressing was performed under conditions: $T_1=670°$ C., $T_2=440°$ C., $t_1=t_2=30$ min, and $P=4.0$ kg f/mm$^2$. The cooling rate from $T_2$ was set at 2° C./min.

The unidirectional reinforced composite material obtained by the forming had a tensile strength of 90 kg f/mm$^2$ or more, and a modulus of elasticity of $21.5\times10^3$ kg f/mm$^3$ or more.

EXAMPLE 3

Material System

Fiber: Polycarbosilane type silicon carbide fiber (tensile strength: 260 kg f/mm$^2$, modulus of elasticity: $18\times10^3$ kg f/mm$^3$)
Matrix metal: Pure Al (melting point: 660° C.)

Preform

A laminate of unidirectional bundles of fiber and pure Al sheets (volume ratio of fiber: 40%)

The preform was packed in a sealing container consisting of a thin plate of mild steel. After the interior of the container was evacuated by a vacuum pump through an evacuation port from a pressure of $5\times10^{-3}$ to $1\times10^{-2}$ Torr, it was heated to 700° C. at a rate of 100° C./min. by an infrared heater. When the container temperature reached 700° C., the container was immediately transferred to a hot press and hot-pressed. Hot pressing was performed under conditions: $T_1=700°$ C., $T_2=400°$ C., $t_1=30$ min, $t_2=45$ min, and $P=2.0$ kg f/mm$^2$. The unidirectional reinforced composite material obtained by the forming had a tensile strength of 85 kg f/mm$^3$ or more, and a modulus of elasticity of $12\times10^3$ kg f/mm$^3$ or more.

EXAMPLE 4

Material System

Fiber: PAN (polyacrylonitrile) type carbon fiber (high strength type) (tensile strength 320 kg f/mm$^2$, modulus of elasticity: $24\times10^2$ kg f/mm$^2$)
Matrix metal: Mg alloy AZ31B (solidus: about 605° C., liquidus: about 632° C.)

Preform

A laminate of unidirectional bundles of fiber and sheets of AZ31B (volume ratio of fiber: 60%)

The preform was packed in a sealing container consisting of a thin plate of mild steel. After the interior of the container was evacuated by a vacuum pump through an evacuation port from a pressure of $5\times-10^{-3}$ to $1\times10^{-2}$ Torr, it was heated to 680° C. at a rate of 100° C./min. by an infrared heater. When the container temperature reached 680° C., the container was immediately transferred to a hot press and hot-pressed. Hot pressing was performed under conditions $T_1=680°$ C., $T_2=550°$ C., $t_1=30$ min, $t_2=60$ min, and $P=3.0$ kg f/mm$^2$. The unidirectional reinforced composite material obtained by the forming had a tensile strength of 150 kg f/mm$^2$ more, and a modulus of elasticity of $15\times10^3$ kg f/mm$^2$ or more.

Industrial Applicability

The present invention can be advantageously adapted for the manufacture of (1) parts required to have a high specific strength and a high specific modulus of elasticity, e.g., structural parts for airplanes, rockets, missiles or the like, space vehicle parts for structures of satellites or the like, jet engine fanplates, and compressor plates; (2) general industrial automobile and transportation equipment parts required to have wear resistance; and (3) sports and leisure products.

EXAMPLE 5

Material System

Fiber: PAN (polyacrylonitrile) carbon fiber (high modulus of elasticity type) (tensile strength: 230 kg f/mm$^3$, modulus of elasticity: $42\times10^3$ kg f/mm$^2$)
Matrix metal: Al alloy 6061 (solidus: about 580° C., liquidus: about 650° C.)

Preform

Alaminate of unidirectional bundles of fiber and sheets of 6061 (volume ratio of fiber: 60%)

The preform was packed in a sealing container consisting of a thin plate of stainless steel. After the interior of the container was evacuated by a vacuum pump through an evacuation port from a pressure of $5\times10^{-2}$ to $1\times10^{-2}$ Torr, it was heated to 680° C. at a rate of 50° C./min by an infrared heater heated to 680° C. at a rate of 50° C./nin by an infrared heater. When the container temperature reached 680° C., the container was immediately transferred to a hot press and hot-pressed. Hot pressing was performed under conditions: $T_1=680°$ C., $T_2=500°$ C., $t_1=30$ min, $t_2=40$ min, and $P=2.5$ kg f/mm$^2$ The unidirectional reinforced composite material obtained by the forming had a tensile strength of 150 kg f/mm$^2$ or more, and a modulus of elasticity of $27\times10^3$ kg f/mm$^3$ or more.

I claim:

1. A method of manufacturing a metal-based composite material, characterized in that a preform laminate consisting of a fibrous inorganic reinforcing material and a matrix metal which is aluminum, an aluminum alloy, magnesium or a magnesium alloy, or a sandwiched body of the fibrous inorganic reinforcing material and metal sheets of foil layers of said matrix metal is packed in a sealing metal container, the container is rapidly heated to a temperature higher than the solidus of the matrix metal while its interior is maintained in a vacuum, and immediately thereafter the container is compressed by a platen heated to and kept at a temperature lower than the solidus of the matrix metal, thereby preparing a composite material of the reinforcing material and the matrix metal, and separating the composite material from the container.

2. A method according to claim 1, wherein the inorganic reinforcing material is one member selected from the group consisting of carbon fiber, silicon carbide fiber, boron fiber, alumina fiber, graphite whisker, silicon carbide whisker, alumina whisker, and silicon nitride whisker.

3. A method according to claim 1, wherein the vacuum pressure in the container is kept not higher than $10^{-2}$ Torr.

4. A method according to claim 1, wherein a heating rate for rapidly heating to the temperature higher than the solidus of the metal is not less than 50° C./min.

5. A method according to claim 1, wherein a heating temperature of the platen falls within a range of a solidus temperature ($T_S$) of the metal and ($T_S$- 200° C.

6. A method according to claim 1, wherein the pressure of the platen is kept constant for a predetermined period of time during a gradual cooling period of the platen, after the material is pressed at a predetermined temperature by the platen.

* * * * *

UNITED STATES PATENT AND TRADEMARK OFFICE

CERTIFICATE OF CORRECTION

PATENT NO. : 4,732,314

DATED : MARCH 22, 1988

INVENTOR(S) : AKIRA SAKAMOTO

It is certified that error appears in the above-identified patent and that said Letters Patent is hereby corrected as shown below:

In the title page, under item [30], "Foreign Application Priority Data", the following item should be deleted: "Nov. 12, 1985 [WO] PCT Int'l Appl. ... PCT/JP85/00629" .

Signed and Sealed this

Eleventh Day of October, 1988

*Attest:*

*Attesting Officer*

DONALD J. QUIGG

*Commissioner of Patents and Trademarks*